United States Patent [19]

Kleefeldt et al.

[11] 4,320,639

[45] Mar. 23, 1982

[54] DRIVERS DOOR LOCK FOR VEHICULAR ANTITHEFT LOCK SYSTEM

[75] Inventors: Frank Kleefeldt, Heiligenhaus; Horst Brackmann, Velbert, both of Fed. Rep. of Germany

[73] Assignee: Kiekert GmbH & Co. Kommanditgesellschaft, Heiligenhaus, Fed. Rep. of Germany

[21] Appl. No.: 154,225

[22] Filed: May 29, 1980

[30] Foreign Application Priority Data

Jun. 1, 1979 [DE] Fed. Rep. of Germany ..... 2922431

[51] Int. Cl.[3] ..... E05B 27/00

[52] U.S. Cl. ..... 70/364 R; 70/337; 70/377

[58] Field of Search ..... 70/337, 338, 339, 340, 70/341, 342, 343, 364 R, 373, 376, 377

[56] References Cited

U.S. PATENT DOCUMENTS 3,969,915 7/1976 Droske ..... 70/364 R
4,075,879 2/1978 Christopher ..... 70/337

FOREIGN PATENT DOCUMENTS 960244 10/1949 France ..... 70/364 R

*Primary Examiner*—Robert L. Wolfe

*Attorney, Agent, or Firm*—Karl F. Ross

[57] ABSTRACT

A tubular lock housing receives a core plug which is rotatable in the housing about an axis between a pair of angularly offset unlock and antitheft positions and through an intermediate lock position. Pluralities of first and second tumblers are exposed at the key-receiving passage of the plug and are diametrally displaceable therein between outer positions lying radially within the outer surface of the core. Differently bitted first and second keys are engageable in the key-receiving passage with the respective tumblers to displace them into the inner positions. At least one inwardly open first recess is formed in the inner wall of the tubular lock housing in radial alignment with the first tumblers only in one end position of the plug, so that these tumblers engage in the first recess when in the outer positions and thereby prevent angular displacement of the plug from the unlocked position. At least one inwardly open second recess is also formed in the inner wall of the lock housing in radial alignment with the second tumblers only in and between this one end position and an intermediate position of the plug. Thus the plug can be moved between the one end position and intermediate position by the first key, but can only be moved into the other end position by the second key.

10 Claims, 9 Drawing Figures

DRIVERS DOOR LOCK FOR VEHICULAR ANTITHEFT LOCK SYSTEM

FIELD OF THE INVENTION

The present invention relates to a lock. More particularly this invention concerns a lock for use in a motor vehicle whose door latches can be secured in a so-called antitheft position.

BACKGROUND OF THE INVENTION

A central vehicle door-lock system of the type described in commonly owned patent applications Ser. Nos. 132,977 and 132,978 both filed Mar. 24, 1980 has several door latches each including a detent movable between a locked position securing the door when closed and an unlocked position allowing the door to be opened by means of a mechanism inside the door latch. Each of these latches is associated with a servoactuator having an actuator that is engageable via this mechanism with the respective detent that is in turn moved by an operator. This operator, therefore, can move the actuator and with it the latch detent between a locked and unlocked position and the operator itself is movable by a servomotor into an antitheft position. A lock pawl on this actuator can, in the locked position of the actuator and the antitheft position of the operator, move from a freeing position permitting displacement of the actuator from the locked to the unlocked position and into a blocking position preventing such displacement to lock up the entire latch. The servomotors are all controlled by a central switch which can operate them all jointly between the locked, unlocked, and antitheft positions. Thus when the switch is in the antitheft position the mechanism of the latches cannot displace the detent into the respective unlocked positions.

Such an arrangement has been found to be an extremely good security precaution, as it not only allows all of the door latches to be locked from a single location, but it allows them to be locked in such a manner that even a person having a key or access to the unlock button of one of the door latches cannot open this latch. The latches can only be moved into the unlocked position when the mechanism has been displaced out of the antitheft position.

To this end it has been normal practice simply to provide a separate three-position switch that controls these functions. The key to this switch has normally remained independent of the regular door-latch keys. Thus it is possible for the owner of a vehicle thus equipped to leave the ignition and door key with another, and yet know that only he himself has the key capable of operating the antitheft mechanism so that if the door-ignition key falls into the wrong hands the owner can still lock up the vehicle.

In order to avoid the necessity of having an extra key, a double-duty lock has been suggested for operation of the driver's door lock. Thus the driver can, simply by operating his own door lock with a special key, lock all of the door latches and displace their mechanisms into the antitheft positions.

This double-duty lock is, however, relatively complex. It is normally necessary to provide two separate sets of tumblers in a two-part core. The outer, central part of the core has one set of tumblers which engage in a sleeve formed on the inner core part and carries the other set of tumblers. The standard door and ignition key can operate the outer core part and displace same between the locked and unlocked positions. Only a special key, however, can reach all the way into the inner core part and actuate its tumblers to displace the lock into the antitheft position.

Such a system is advantageous in that the operator of the vehicle can retain the key that operates the antitheft mechanism and, if necessary give out other keys that operate the other systems. Nonetheless, such lock assemblies have proven extremely complex. They must be made carefully, as any failure to stay within very close tolerance will normally have a cumulative effect so that the lock will not operate. What is more, such a lock is relatively long so that mounting it in the motor-vehicle door becomes a problem, in particular when window mechanism must be allowed for. The cost of making such a lock is also relatively high, and the key must normally be a special extra-long key. Finally all of the other door locks in the car must be so constructed that they can accept this extra-long key, again raising the cost of the system incorporating such a lock.

OBJECTS OF THE INVENTION

It is therefore an object of the present invention to provide an improved lock usable in an arrangement such as described in the above-cited copending applications, whose entire disclosures are herewith incorporated by reference.

Another object is to provide a double-duty lock assembly which can be made in substantially the same size as a conventional lock.

Another object is to provide such a lock assembly whose keys are indistinguishable from standard keys.

SUMMARY OF THE INVENTION

These objects are attained according to this invention in a lock assembly whose tubular lock housing has an inner wall generally centered on an axis and closely radially juxtaposed with the outer surface of a core plug which in turn has a central axially extending key-receiving passage. This plug is rotatable in the housing about the axis thereof between a pair of angularly offset end positions and through an intermediate position between the end positions. The end positions may constitute the unlock and antitheft positions and the intermediate position may constitute the lock position. Pluralities of first and second tumblers are exposed at the passage in the plug and are diametrally displaceable therein between outer positions projecting radially beyond the outer surface of the plug and inner positions lying radially within the outer surface. Differently bitted first and second keys are engageable in the passage with the respective tumblers to displace same into the inner positions. At least one inwardly open first recess is formed in the inner wall in radial alignment with the first tumblers only in one of the end positions of the plug. These first tumblers engage in the first recess when in the outer position and thereby prevent angular displacement of the plug from the one end position when the first tumblers are in the outer positions. At least one inwardly open second recess is also formed in the inner wall of the plug in radial alignment with the second tumblers only in and between the one end position and the intermediate position of the plug. The second tumblers engage in the second recess only in and between the one end position and the intermediate position when in the outer positions and thereby prevent angular displacement of the plug into the other end position with the second tumblers in the outer positions. Thus the plug can be turned between the one end and intermediate position with the second key. In effect the second tumblers permit displacement of the core plug between the one end position—normally the unlocked position—and the intermediate position—normally the lock position—but prevent displacement into the other end position—normally the antitheft position—unless they are acted on by the second key.

According to this invention, therefore, it is possible for a relatively simple lock to provide the exact functions needed. Namely, the lock can easily be operated in the conventional manner between the locked and unlocked position by the standard door key, but can only be displaced into the antitheft position by the use of a special key.

The axial length of the lock according to this invention is minimized by alternating the first and second tumblers and, in fact, by forming the plug with a plurality of radially extending passages that traverse the axial passages and that each receive one respective first tumbler and one respective second tumbler.

According to another feature of this invention the inner wall is formed with axially spaced and angularly extending grooves that form the second recess and that are alignable respectively with the second tumblers. The inner wall is also formed with an axially extending groove that forms the first recess.

The tumblers according to this invention have respective actuation edges that are axially one behind the other and the keys have respective bitted edges engageable with the respective actuation edges. The actuation edges of the first tumblers lie to one side of a plane passing through the axis and the actuation edges of the second tumblers lie to the other side of this plane. Similarly when the keys are inserted in the passage of the plug the bitted edge of the first key lies to the one side of the plane and the bitted edge of the second key lies to the other side of the plane, it being understood that both of the keys cannot fit in the passage at the same time. With the system according to the instant invention, therefore, it is possible for two keys of the same overall dimensions to operate the same lock mechanism, with the one key being able to displace the mechanism into a third position that the other cannot. Using plate tumblers urged into their outer position by respective springs further increases the compactness of the lock assembly according to the instant invention.

In accordance with yet another feature of the instant invention means is provided including interengaging formations on the tumblers that displace the first tumblers into the inner positions on displacement of the respective second tumblers by the second key into the inner positions. This operation is possible simply by providing small axially projecting pins on the first tumblers that engage in radially outwardly open notches on the second tumblers. Thus the first tumblers—which are associated with the lock and unlock functions only—can move radially inwardly independently of the second tumblers—which are associated with the antitheft function—but the second tumblers when moved radially inwardly will inherently entrain the first tumblers.

According to another feature of this invention the keys may be double-bitted. Thus half of the tumblers associated with the lock function will move radially in one direction into the inner position and the other will move radially in the opposite direction. Thus with six-bitted keys the lock will have twelve tumblers, two sets of six, so that picking the lock becomes an extremely difficult job.

SPECIFIC DESCRIPTION

Figure 1:
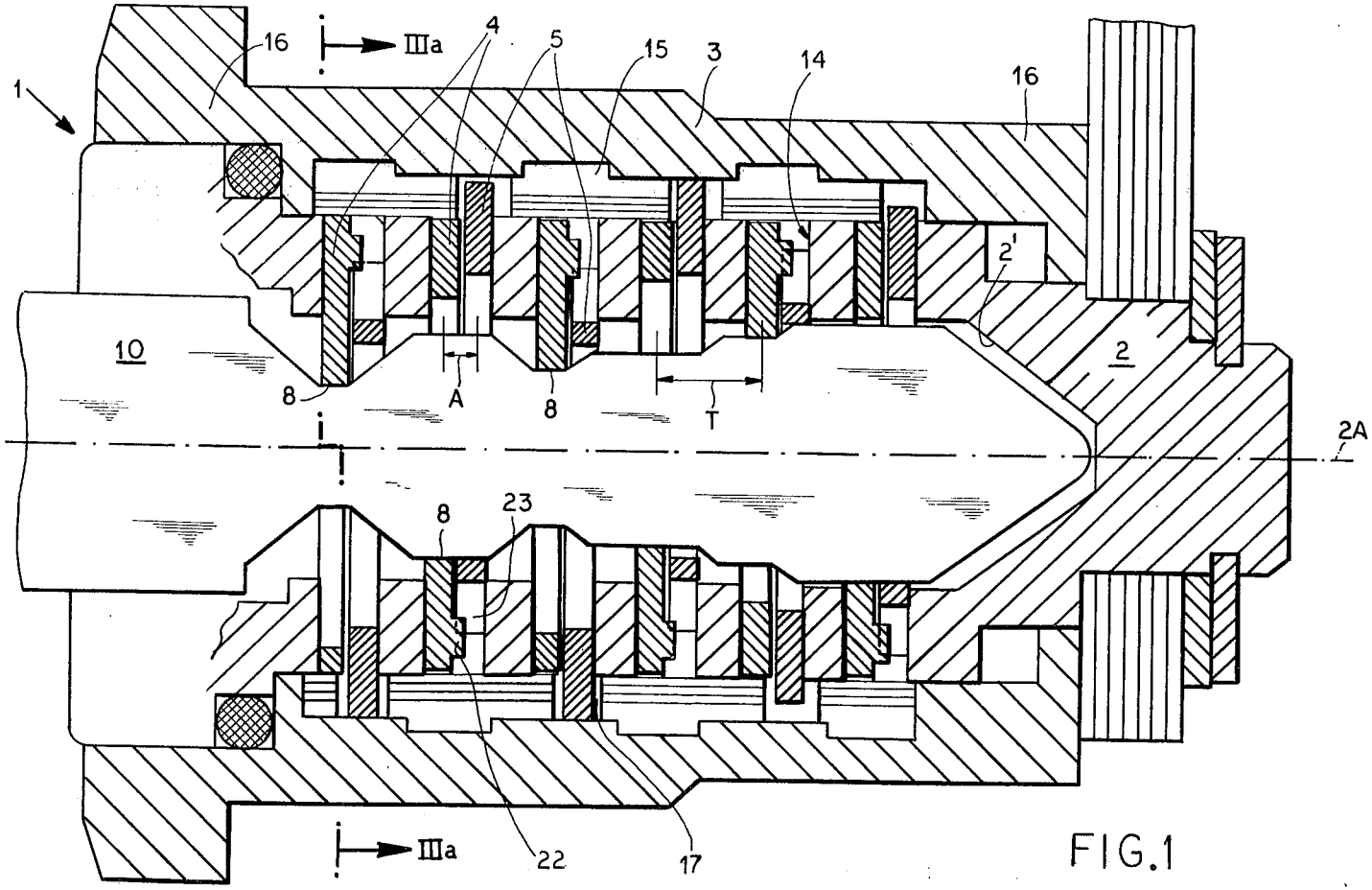
FIG. 1 is an axial section through the driver-door lock according to this invention with the lock key in place.
Figure 2:
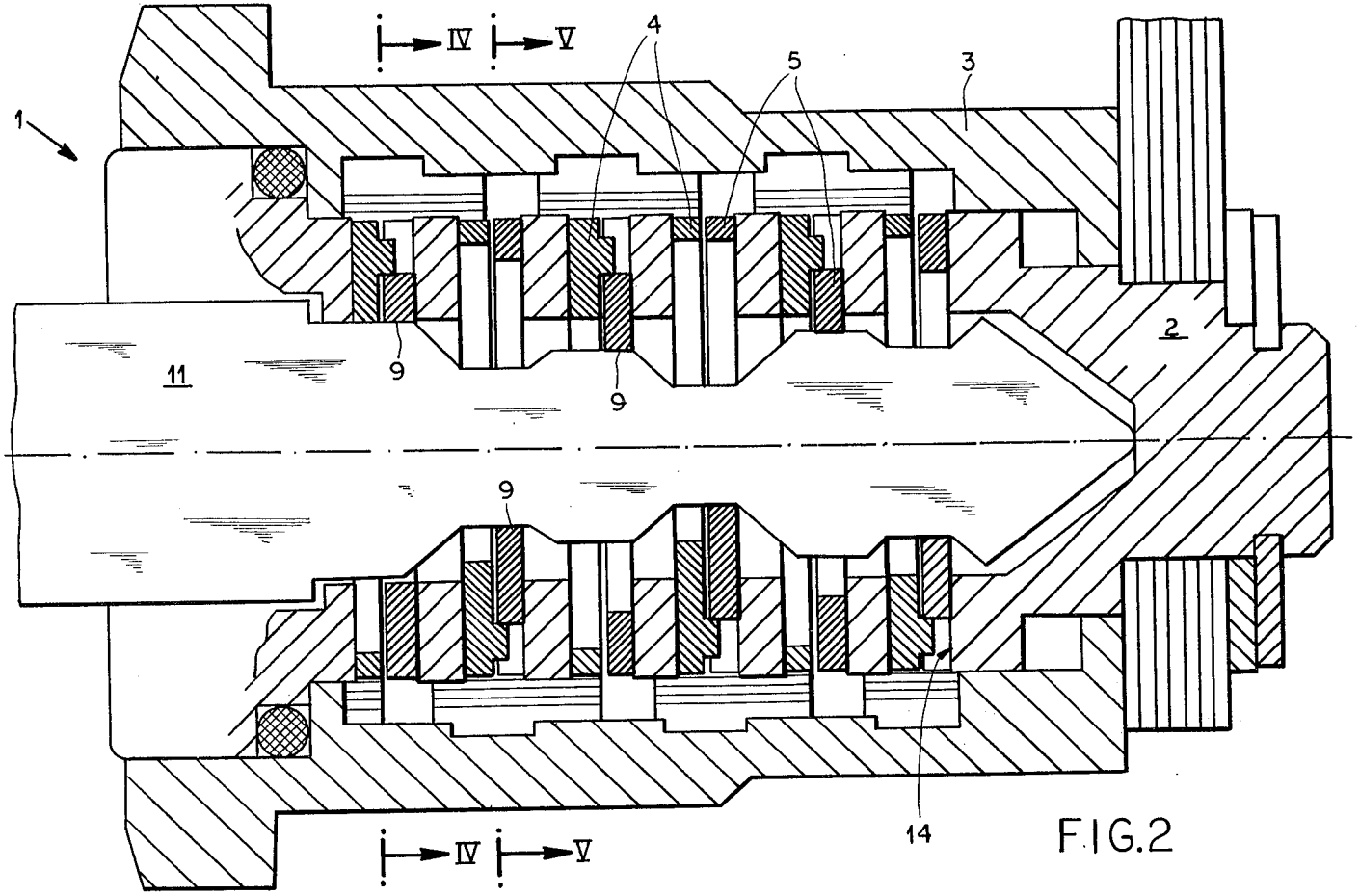
FIG. 2 is an identical axial section but with the antitheft key in place.
Figure 6:
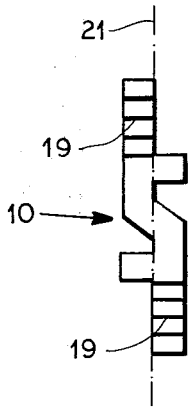
FIGS. 6 and 7 are end views of the lock and antitheft keys, respectively, according to the instant invention.
Figure 7:
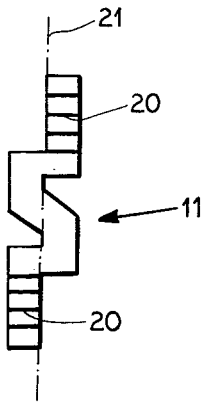

As seen in FIGS. 1 and 2 a driver-door lock 1 has a core 2 rotatable about a core axis 2A inside a cylindrical housing or cylinder 3. Radially displaceable in the core 2 are lock plate tumblers 4 and antitheft plate tumblers 5 having respective central apertures 6 and 7 formed as also seen in FIGS. 3*a*–5 with respective control edges 8 and 9. Either a lock key 10 shown in FIG. 1 and in end view of FIG. 6 or an antitheft key 11 shown in FIG. 2 and in an end view of FIG. 7 can operate this lock 2, with the lock key 10 only being engageable with control edges 8 and the key 11 only with the control edges 9. The tumblers 4 and 5 are formed adjacent their other ends with standard axially extending ridges 4' and 5'.

In a manner known per se these plate tumblers 4 and 5 are urged into radial outer positions by respective springs 12 and 13, with three of the lock tumblers and of the antitheft tumblers urged radially in one direction and the other three lock tumblers and other three plate tumblers being urged radially in the opposite direction, as the keys 10 and 11 are double-bitted. To this end the core 2 is formed with six transversely throughgoing passages forming guides 14 that cross the central key-receiving passage 2' formed in the core 2. Thus the overall length of the lock need not exceed that of a standard six-bit lock. The tumblers 4 are each spaced on centers from the adjacent tumblers 5 by a relatively short distance A, and the pairs of tumblers are spaced along the axis 2A by a standard distance indicated at T in FIG. 1. In fact the system is so very compact that it can even take the place of a standard six-bit cylinder.

Figure 3A:
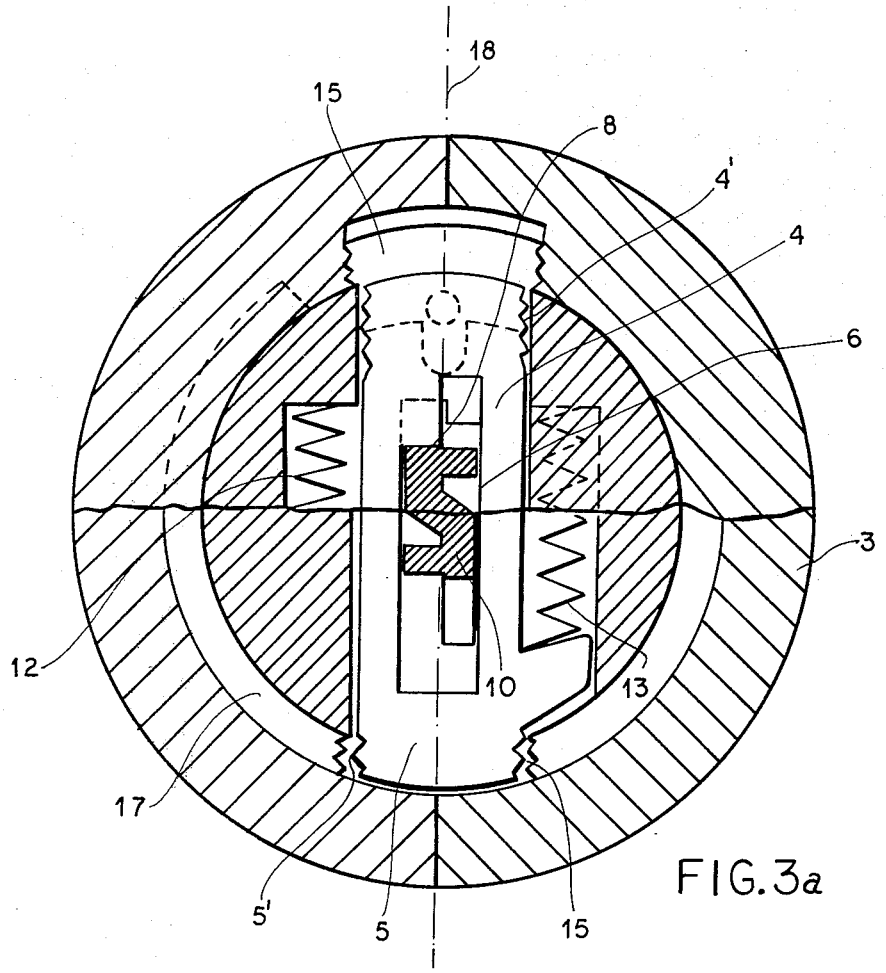
FIG. 3*a* is a section taken along line III*a*—III*a* of FIG. 1.
Figure 3C:
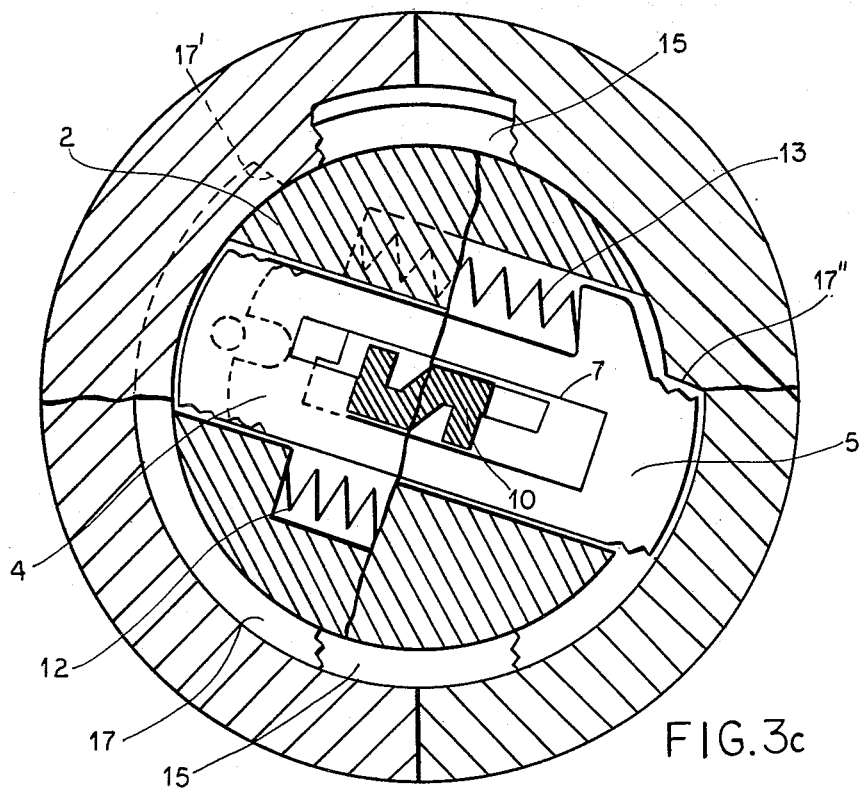
FIGS. 3*b* and 3*c* are views similar to FIG. 1 but showing the lock in two other positions.
Figure 3B:
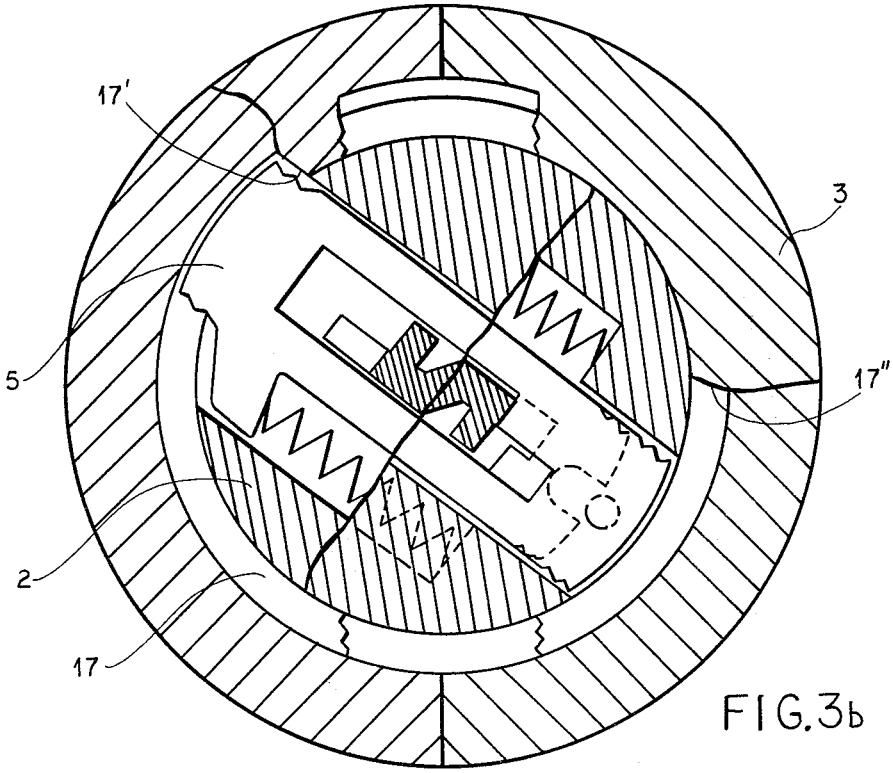
Figure 4:
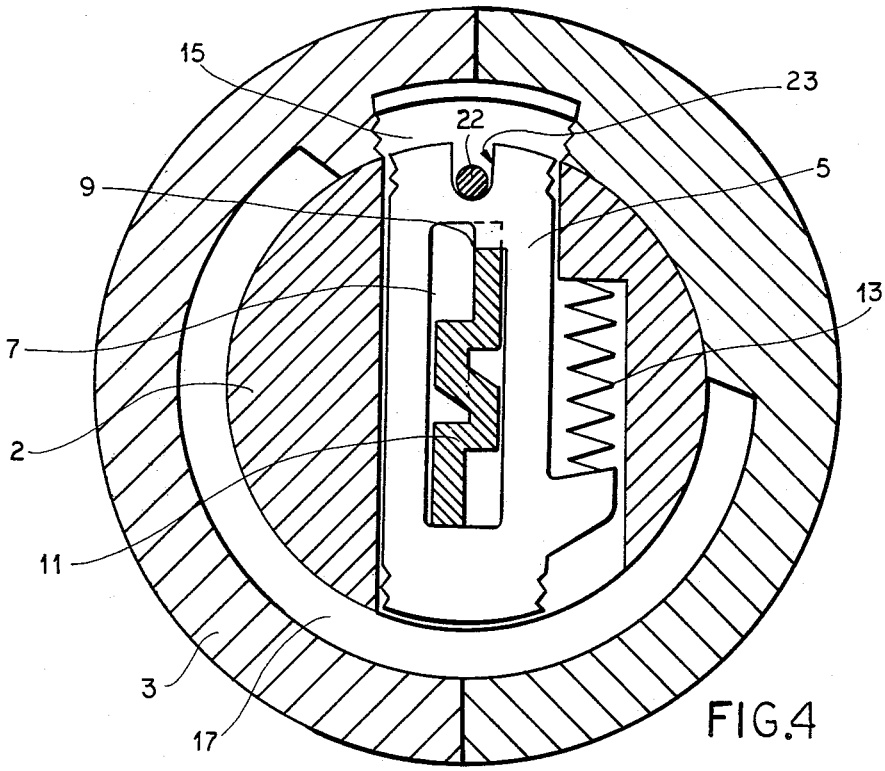
FIGS. 4 and 5 are sections taken along lines IV—IV and V—V of FIG. 2.
Figure 5:
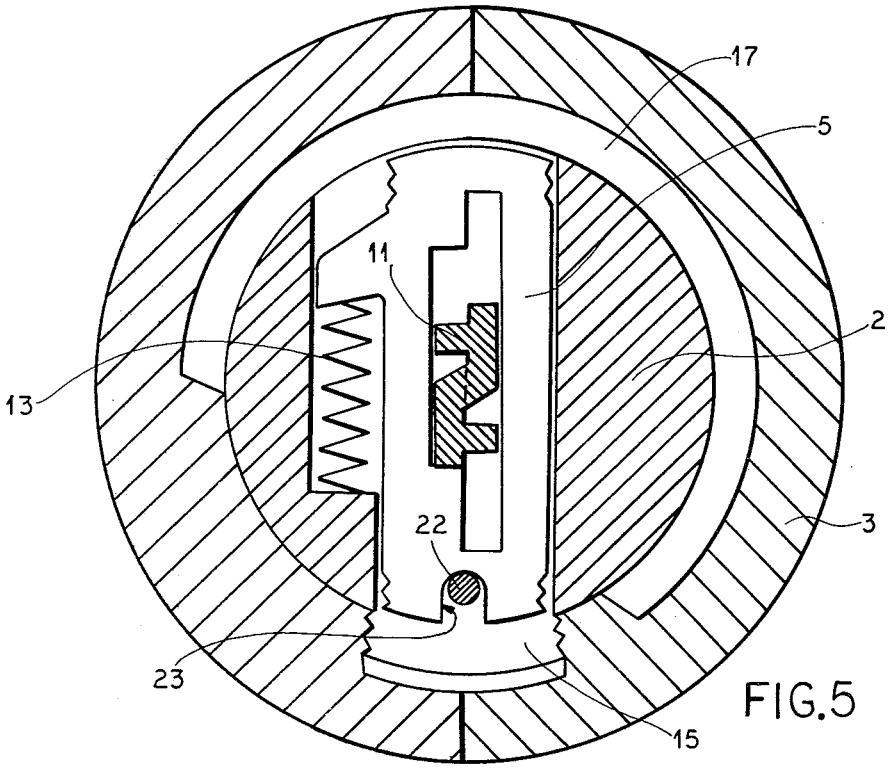

The cylindrical housing 3 for the core 2 is formed with a pair of diametrically opposite and axially extending grooves 15 in which the outer ends of the tumblers 4 engage in the position shown in FIG. 3*a* as well as in FIGS. 4 and 5, a position which could be an end position but which in this embodiment is actually a central starting position lying between the lock and unlock positions shown respectively in FIGS. 3*b* and 3*c*. The housing 3 is formed with a cylindrical journal surface 16 adjacent one end of the passage 2' for such rotation of the core 2 about the axis 2A. These grooves 15'' have ridged edges that can mate with the edges 4'' and as an antipicking measure.

These end positions are defined by angularly extending and inwardly open grooves 17 each aligned with the outer end of a respective one of the antitheft tumblers 5. When these tumblers 5 are in their projecting or outer positions as shown in FIGS. 3*b* and 3c they can move from the starting position shown in FIG. 3*a*, which is the only position in which a key can be inserted into it withdrawn from the passage 2', either approximately 130° clockwise into the lock position of FIG. 3*b* or approximately 70° counterclockwise into the unlock position of FIG. 3*c*. In the former position the ends of the tumblers engage ends 17' of the respective grooves 17 and in the latter they engage ends 17'' of the grooves 17. It is therefore possible to use the key 10 to displace the lock tumblers 4 into the inner positions, thereby disengaging them from the recesses 15, and to then rotate the core 2 between the lock and unlock positions. It is, however, impossible to displace the core 2 beyond these positions into the antitheft position which is normally offset by a full 180° or more from the starting position of FIG. 3*a*. In fact the entire core can be turned over in the antitheft position so that it is impossible to get the core back into any other position without use of the special antitheft key 11.

As is apparent from FIG. 3*a* the actuation or control edges 8 and 9 of the tumblers 4 and 5 lie to opposite sides of a plane 18 bisecting the two recesses or grooves 15 and the eumblers 4 and 5 in their starting positions. Similarly as can be seen from FIGS. 6 and 7 the keys 10 and 11 have actuation formations or bitted edges 19 and 20 lying to opposite sides of a plane 21 bisecting these keys 10 and 11 and lying on the plane 18 when the keys 10 and 11 are inserted in the passage 2' and through the apertures 6 and 7. Obviously the control edges 8 and 9 are differently spaced from the respective ends of the respective tumblers 4 and 5, and the keys 10 and 11 are formed with appropriate bits that move into the inner positions in a manner well known in the art. The tumblers 4 and 5 can all be positioned so that they lie wholly within the cylinder defined by the outer surface of the core 2 on the axis A.

Thus the bits 19 of the lock key 10 will not be able to engage the control edges 9 of the tumblers 5 at all, and correspondingly the bits 20 of the key 11 will not be able to engage the control edges 8 of the tumblers 4. This allows the two keys 10 and 11 to be bitted totally differently. Both of the tumblers 4 and 5 in each of the guides 14 are urged in the same diametral direction by the respective spring 12 and 13. The lock tumblers 4 are formed with small protrusions 22 that can engage in slots or notches 23 of the respective antitheft tumblers 5. These formations 22 and 23 are provided at the ends of tumblers 4 and 5 that are the leading ends in the diametral direction of displacement of the tumblers. As mentioned above, alternate pairs of tumblers 4 and 5 move in opposite diametral directions to foil picking of the lock.

It is therefore possible by means of the antitheft key 11 as shown in FIG. 2 to displace all of the antitheft tumblers 5 into the inner position in which they lie within the cylindrical surface defined by the surface of the core 2, and simultaneously to entrain the respective tumblers 4 into the inner positions also by means of the interengaging formation 22 and 23. The key 11 is therefore effective via the respective tumblers 5 and formations 22 and 23 on the tumblers 4, but does not itself directly contact them. With the key 11 in place as shown in FIGS. 2, 4 and 5, it is therefore possible to rotate the core 2 at will about the axis 2A. Normally a third antitheft position is provided to the other side of the lock position shown in FIG. 3*b*, so that the user must turn the key 11 through an almost entire revolution about the axis 2*A* to operate the antitheft mechanism described in the above-cited copending application.

Thus the owner of a vehicle equipped with a sophisticated antitheft system such as that described in the above-identified application may give out the door key and ignition key of the vehicle without having to give out the key that operates the antitheft device. Thus even if the door key falls into the hands of a car thief it will be impossible for this person to deactivate the antitheft protection to open any of the vehicle doors. This is particularly the case when the antitheft position is set up so that the entire core is turned upside down in the antitheft position, so that even the appropriate door key is not able to move the core back into the unlock position shown in FIG. 3*c*.

We claim:

1. A lock assembly comprising:

a tubular lock housing having an inner wall generally centered on an axis;

a core plug in said housing having an outer surface closely juxtaposed radially with said inner wall and a centrally axially extending key-receiving passage, said plug being rotatable in said housing about said axis between a pair of angularly offset end positions and through an intermediate position between said end positions;

pluralities of first and second tumblers alternating axially, exposed at said passage in said plug, and diametrally displaceable therein between outer positions projecting radially beyond said outer surface and inner positions lying radially within said outer surface, said plug being formed with a plurality of radially extending passages traversing said axial passage and each receiving one respective first tumbler and one respective second tumbler;

differently bitted first and second keys engageable in said passage with the respective tumblers to displace same into said inner positions;

an axially extending groove formed in said inner wall and forming at least one inwardly open first recess in radial alignment with said first tumblers only in one of said end positions of said plug, said first tumblers engaging in said first recess when in said outer positions and thereby preventing angular displacement of said plug from said one end position with said first tumblers in said outer position;

respective axially spaced and angularly extending grooves formed in said inner wall and forming at least one inwardly open second recess in said inner wall in radial alignment with said second tumblers only in and between said one end position and said intermediate position of plug, said second tumblers engaging in said second recess only in and between said one end position and said intermediate position when in said outer positions and thereby preventing angular displacement of said plug into the other end position with said second tumblers in said outer positions, whereby said plug can be turned between said one end and intermediate positions with said first key but can only be turned into said other end position with said second key; and means including interengaging formations on said tumblers for displacing said first tumblers into said inner positions on displacement of the respective second tumblers by said second key into said inner positions.

2. A lock assembly comprising:

a tubular lock housing having an inner wall generally centered on an axis;

a core plug in said housing having an outer surface closely juxtaposed radially with said inner wall and a centrally axially extending key-receiving passage, said plug being rotatable in said housing about said axis between a pair of angularly offset end positions and through an intermediate position between said end positions;

pluralities of first and second tumblers exposed at said passage in said plug and diametrically displaceable therein between outer positions projecting radially beyond said outer surface and inner positions lying radially within said outer surface;

differently bitted first and second keys engageable in said passage with the respective tumblers to displace same into said inner positions;

at least one inwardly open first recess formed in said inner wall in radial alignment with said first tumblers only in one of said end positions of said plug, said first tumblers engaging in said first recess when in said outer positions and therby preventing angular displacement of said plug from said one end position with said first tumblers in said outer position;

at least one inwardly open second recess formed in said inner wall in radial alignment with said second tumblers only in and between said one end position and said intermediate position of said plug, said second tumblers engaging in said second recess only in and between said one end position and said intermediate position when in said outer positions and thereby preventing angular displacement of said plug into the other end position with said second tumblers in said outer positions, whereby said plug can be turned between said one end and intermediate positions with said first key but can only be turned into said other end position with said second key; and means including interengaging formations on said tumblers for displacing said first tumblers into said inner positions on displacement of the respective second tumblers by said second key into said inner positions.

3. The assembly defined in claim 2 wherein said inner wall is formed with axially spaced and angularly extending grooves forming said second recess and alignable respectively with said second tumblers.

4. The assembly defined in claim 3 wherein said inner wall is formed with an axially extending groove forming said first recess.

5. The assembly defined in claim 4 wherein said first and second tumblers alternate axially.

6. The assembly defined in claim 5 wherein said plug is formed with a plurality of radially extending passages traversing said axial passage and each receiving one respective first tumbler and one respective second tumbler.

7. The assembly defined in claim 5 wherein said tumblers have respective actuation edges axially one behind the other, said keys having respective bitted edges engageable with the respective actuation edges.

8. The assembly defined in claim 7 wherein said actuation edges of said first tumblers lie to one side of a plane passing through said axis and said actuation edges of said second tumblers lie to the other side of said plane.

9. The assembly defined in claim 2 wherein said tumblers are plates lying in planes perpendicular to said axis and having respective windows at said passage.

10. The assembly defined in claim 2, further comprising springs urging said tumblers into said outer positions.

* * * * *